US006401607B2

(12) United States Patent
Yoneoka

(10) Patent No.: US 6,401,607 B2
(45) Date of Patent: Jun. 11, 2002

(54) STENCIL PRINTING SYSTEM, STENCIL PRINTING METHOD, AND COMPUTER-READABLE RECORDING MEDIUM STORING STENCIL PRINTING PROGRAM

(75) Inventor: Hideharu Yoneoka, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/753,688

(22) Filed: Jan. 4, 2001

(30) Foreign Application Priority Data

Jan. 12, 2000 (JP) ..... 2000-003602

(51) Int. Cl.[7] ..... B41M 1/12

(52) U.S. Cl. ..... 101/129; 101/128.4

(58) Field of Search ..... 101/114, 116, 101/128.21, 128.4, 129

(56) References Cited

U.S. PATENT DOCUMENTS 5,970,869 A * 10/1999 Hara et al. ..... 101/128.4
6,076,460 A * 6/2000 Kagawa ..... 101/116
6,101,263 A * 8/2000 Shimizu et al. ..... 382/100
6,302,017 B1 * 10/2001 Kawai et al. ..... 101/128.4

FOREIGN PATENT DOCUMENTS

JP 4-14166 * 1/1992

* cited by examiner

*Primary Examiner*—Ren Yan
(74) *Attorney, Agent, or Firm*—Nath & Associates PLLC; Gary M. Nath

(57) ABSTRACT

The disclosed stencil printing machine automatically judges the process to be executed by referring to the operation waiting state of the controller and its own operation waiting state. According to this disclosed structure, the user's operation of printing process is enhanced, and the efficiency of printing process is heightened.

6 Claims, 8 Drawing Sheets

FIG. 6

| | | OPERATION STATE OF PRINTING MACHINE | |
|---|---|---|---|
| | | STENCIL MAKING MODE | PRINTING MODE |
| STATE OF CONTROLLER | NO OUTPUT | OPERATION BANNED | INDEPENDENT PRINTING PROCESS BY PRINTING MACHINE |
| | WAIT FOR STENCIL MAKING | STENCIL MAKING INSTRUCTION | INDEPENDENT PRINTING PROCESS BY PRINTING MACHINE |
| | WAIT FOR PRINTING | STENCIL RE-MAKING INSTRUCTION | PRINTING INSTRUCTION |

STENCIL PRINTING SYSTEM, STENCIL PRINTING METHOD, AND COMPUTER-READABLE RECORDING MEDIUM STORING STENCIL PRINTING PROGRAM

BACKGROUND OF THE INVENTION

1. Field of the Invention

The present invention relates to a stencil printing system, stencil printing method, and computer-readable recording medium storing stencil printing program for receiving print information from a computer system through a controller, and executing stencil making of print information and printing process on a stencil printing machine, and more particularly to an art of realizing efficient stencil making and printing process.

2. Description of the Related Art

Generally, when issuing the print information stored in a computer system such as PC (personal computer) in a stencil printing machine, as shown in FIG. 1, a controller 71 for controlling transmission of print information from a computer system 70 to a stencil printing machine 72 is installed between the computer system 70 and stencil printing machine 72, and a stencil printing system is built up. When issuing the print information from the computer system 70 to the stencil printing machine 72, the following processing steps as shown in FIG. 2 are executed.

(1) Print information is issued from the computer system 70 into the controller 71 (print information output step S801).

(2) The controller 71 judges if the stencil printing machine 72 is online or offline (online/offline judging step S802). As a result of judgement, if the stencil printing machine 72 is online, the process goes to stencil making command output step (S803), or if the stencil printing machine 72 is offline, the process goes to offline changeover step (S804). Herein, "offline" is a state (mode) of executing stencil making and printing process by using the print information possessed by the stencil printing machine itself, and "online" means the state of executing stencil making and printing process by the stencil printing machine by using the print information from the computer, and when the stencil printing machine is online, generally, process designated from the operation system of the stencil printing machine is not accepted at all. The reason why the two states of online and offline are provided in the stencil printing machine is that the stencil printing machine, unlike an ordinary printer, has a stencil making function, and is designed to execute printing process either independently or from the computer system, and by the provision of such two states, during execution of stencil making and printing process by the stencil printing machine by using the print information from the computer system, it is designed to prevent troubles of execution of other stencil making or printing process by mistake from the operation system on the stencil printing machine.

(3) When the stencil printing machine 72 is online, the controller 71 transmits a stencil making process command of print information to the stencil printing machine 72, and the stencil printing machine 72 receives the stencil making process command, and executes stencil making process for preparing the stencil of the print information (stencil making command output step S803), and after finishing the stencil making process, the process goes to the print process execution step (S805).

(4) When the stencil printing machine 72 is offline, the controller 71 waits until the stencil printing machine 72 becomes online (online waiting step S804) , and when the stencil printing machine 72 is changed over to the online state, the process goes to the stencil making command output step (S803).

(5) The stencil printing machine 72 executes the printing process by using the stencil fabricated in the stencil making process (printing process execution step S805).

(6) The controller 71 judges if there is other print information from the computer system 70, and if there is other print information, the process goes again to the print information output step (S801). On the other hand, if there is no other print information, the stencil printing process is terminated (judging step S806).

Thus, in the conventional stencil printing system, the online and offline states are provided in the stencil printing machine, and the controller judges whether the stencil printing machine is online or offline, and transmits the print information stored in the computer system to the stencil printing machine, but the conventional stencil printing system involves the following technical problems to be solved.

Firstly, in the existing stencil printing system, if paper jamming or other error occurs in the stencil printing machine while the printing process of the print information from the computer system is being executed on the stencil printing machine, the stencil printing machine becomes offline and is hence stopped. Accordingly, to continue the printing process on the stencil printing machine, the user has to restore the stencil printing machine to the online state by using online/offline changeover means such as I/F key provided on the stencil printing machine, and the efficiency of printing process is poor. Further, in the offline state, since other printing process can be started by the stencil printing machine alone, if other printing process has been started in the stencil printing machine, the print information from the computer system is interrupted in unprocessed state, and it is difficult to realize printing process of high efficiency.

Secondly, in the case of the conventional stencil printing system, since the stencil printing machine has the function of processing both stencil making and printing, the controller issues stencil making process command and printing process command alternately, but in such a system, for example, if a request for printing extra 5 sheets is made after the computer system starts printing process for printing 5 sheets of print information A, if the stencil printing machine is in online state after finishing the printing process, stencil making process by other print information is executed. In the conventional stencil printing system, therefore, if desired to extraportion of print information, it is required to change over the printing method while considering the state of the controller, such as execution of printing process by the stencil printing machine independently without changing over online or offline state, and the operation is completely complicated.

Thus, in the conventional stencil printing system, the stencil printing machine has two operation states of online and offline, and the controller judges whether the stencil printing machine is online or offline, and the print information stored in the computer system is issued to the stencil printing machine, and therefore the operation of printing process is very much complicated, and the efficiency of printing process is very poor.

SUMMARY OF THE INVENTION

The invention is devised in the light of the above technical problems, and the object of the invention is to improve the operation of printing process, and present a stencil printing machine enhanced in the efficiency of printing process.

And the other object of the invention is to improve the operation of printing process, and present a stencil printing method enhanced in the efficiency of printing process.

And also, the further object of the invention is to improve the user's operation of printing process, and present a computer-readable recording medium storing a stencil printing process for enhancing the efficiency of printing process.

To solve these technical problems, the inventor discovered that the user's operation of printing process is enhanced and that the efficiency of printing process is heightened, by using the controller which informs the stencil printing machine of the operation waiting state, and the stencil printing machine which refers to the operation state off the operation system of its own and the informed operation waiting state of the controller, judges automatically the process to be executed, and informs the controller of the content of processing, and continued to accumulate intensive researches, and finally reached the technical concept having the following features.

A first feature of the invention based on such concept is a stencil printing system for receiving print information from a computer system through a controller, and executing stencil making and printing process of print information on a stencil printing machine, in which the stencil printing machine comprises an operation waiting state detector for detecting the operation waiting state of the controller, a printing machine operation state detector for detecting the operation state of the stencil printing machine, and a judging unit for determining the process to be executed on the stencil printing machine by referring to the operation waiting state of the controller and the operation state of the printing machine, and controlling the controller and the stencil printing machine.

Hence, the user's operation of printing process is enhanced, and the efficiency of printing process is heightened.

A second feature of the invention based on such concept is a stencil printing method for receiving print information from a computer system through a controller, and executing stencil making and printing process of print information on a stencil printing machine, which comprises a operation waiting state detecting step of detecting the operation waiting state of the controller, a printing machine operation state detecting step of detecting the operation state of the stencil printing machine, and a judging step of determining the process to be executed on the stencil printing machine by referring to the operation waiting state of the controller and the operation state of the printing machine, and controlling the controller and the stencil printing machine.

Hence, the user's operation of printing process is enhanced, and the efficiency of printing process is heightened.

A third feature of the invention based on such concept is a computer-readable recording medium storing a stencil printing program for receiving print information from a computer system through a controller, and executing stencil making and printing process of print information on a stencil printing machine, which comprises a operation waiting state detecting process of detecting the operation waiting state of the controller, a printing machine operation state detecting process of detecting the operation state of the stencil printing machine, and a judging process of determining the process to be executed on the stencil printing machine by referring to the operation waiting state of the controller and the operation state of the printing machine, and controlling the controller and the stencil printing machine, thereby causing the computer to execute these processes.

Hence, the user's operation of printing process is enhanced, and the efficiency of printing process is heightened.

Herein, the recording medium includes, for example, semiconductor memory, magnetic disk, optical disk, magneto-optical disk, magnetic tape and other computer-readable medium in which programs can be recorded.

The operation waiting state of the controller includes the no-output state, stencil making process waiting state, and printing process waiting state, and the operation state of the printing machine includes the stencil making process state and the printing process state, and by referring to these states, the process to be executed on the stencil printing machine is determined.

Other and further objects and features of the present invention will become obvious upon understanding of the illustrative embodiments about to be described in connection with the accompanying drawings or will be indicated in the appended claims, and various advantages not referred to herein will occur to one skilled in the art upon employing of the invention in practice.

BRIEF DESCRIPTION OF THE DRAWINGS

FIG. 6 is a diagram explaining a stencil printing method in the embodiment of the invention.

DETAILED DESCRIPTION OF THE PREFERRED EMBODIMENTS

Figure 1:
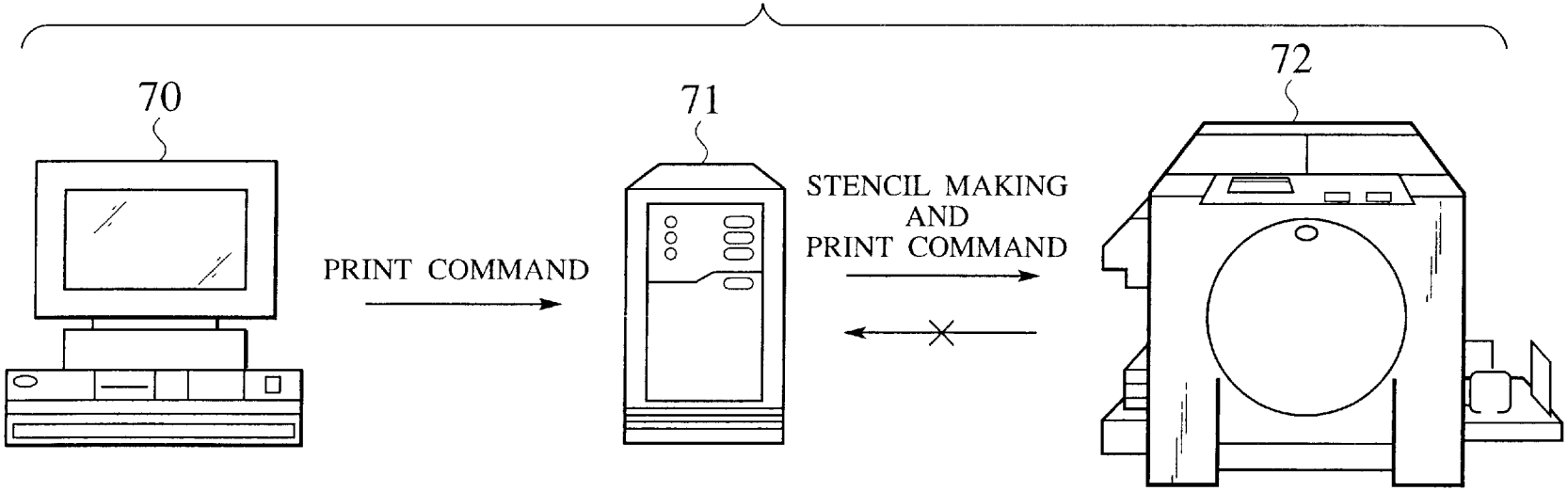
FIG. 1 PRIOR ART
FIG. 1 is a block diagram showing a configuration of a conventional stencil printing machine.

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Referring now to FIG. 3 to FIG. 8, the configuration and operation of the stencil printing system, stencil printing method, and computer-readable recording medium storing stencil printing program of the invention are described in detail below. In this embodiment, suppose the stencil printing machine is not provided with scanner (scanning reading device) for reading the print information. Generally, the stencil printing machine without scanner cannot execute stencil making process independently, but can execute printing process independently as far as the stencil is ready. The stencil printing machine furnished with scanner can realize the stencil printing system and its method of the invention and brings about the same effects if it is further provided with means (not shown) for judging if the start command of stencil making process is coming from the scanner or from the computer.

To begin with, the radical technical concept of the stencil printing system and its method of the invention is explained.

In the stencil printing system and method of the invention, different from the prior art, it is intended to eliminate the discrimination between the operation system used in independent operation of the stencil printing machine such as the changeover key of stencil making process and printing process or process start key of the stencil printing machine, and the operation system used in control of output from the computer system such as online/offline changeover means (I/F key), and further to get rid of the online/offline changeover means. Accordingly, in the stencil printing system and method of the invention, as shown in FIG. 3, when the controller informs the stencil printing machine of operation waiting state such as no-output state, stencil making process wait or printing process wait, the stencil printing machine refers to the operation state of the own operation system and the informed operation waiting state of the controller, and judges the process to be executed, and reports the content of process to the controller, thereby composing an interactive structure.

The stencil printing system and its method in an embodiment of the invention realized from this technical concept are explained below while referring to FIG. 3 to FIG. 8.

Figure 3:
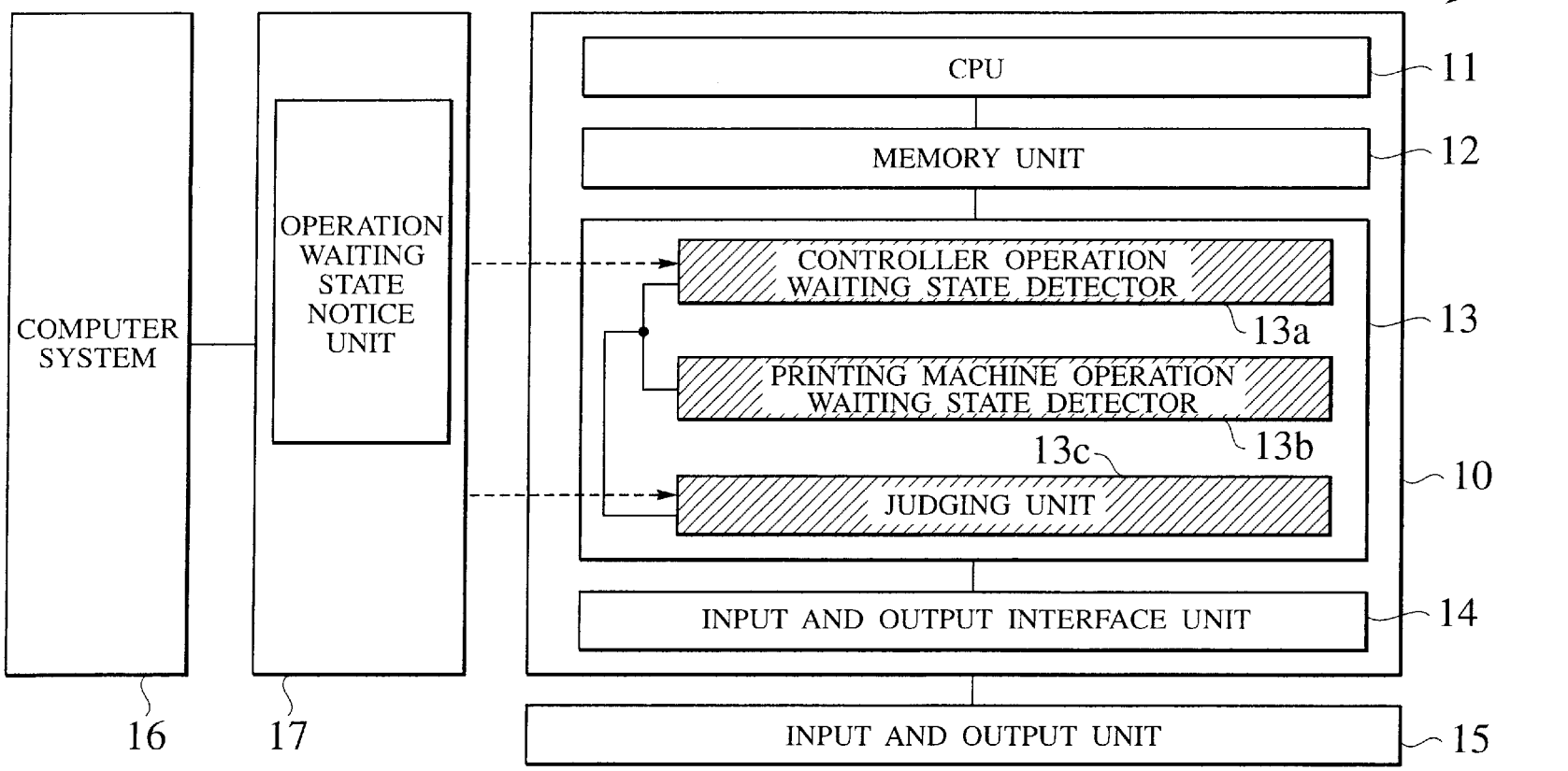
FIG. 3 is a block diagram showing a configuration of a stencil printing system in an embodiment of the invention.

FIG. 3 is a schematic diagram showing a configuration of the stencil printing system in the embodiment of the invention.

The stencil printing system in the embodiment of the invention comprises, as shown in FIG. 3, a stencil printing machine 10 for executing stencil making process and printing process by using print information, a computer system 16 storing print information, and a controller 17 for sending and receiving print information between the stencil printing machine 10 and computer system 16.

The stencil printing machine 10 of the embodiment of the invention includes a CPU 11 for controlling the stencil printing process, memory means 12 for storing the stencil printing program, a stencil making/printing process interface unit 13 for sending and receiving print information between the controller 17 and the stencil printing machine 10, and an input and output interface unit 14 for controlling input and output signals relating to the stencil printing machine 10, and the stencil making/printing process interface unit 13 further includes a controller operation waiting state detector 13*a* for detecting the operation waiting state of the controller 17, a printing machine operation state detector 13*b* for detecting the operation state of the stencil printing machine 10, and a judging unit 13*c* for judging the process to be executed on the basis of the operation state of the controller 17 and stencil printing machine 10.

Further, the controller 17 of the embodiment of the invention includes an operation waiting state notice unit 17*a* for informing the stencil printing machine 10 of the operation waiting state.

Figure 2:
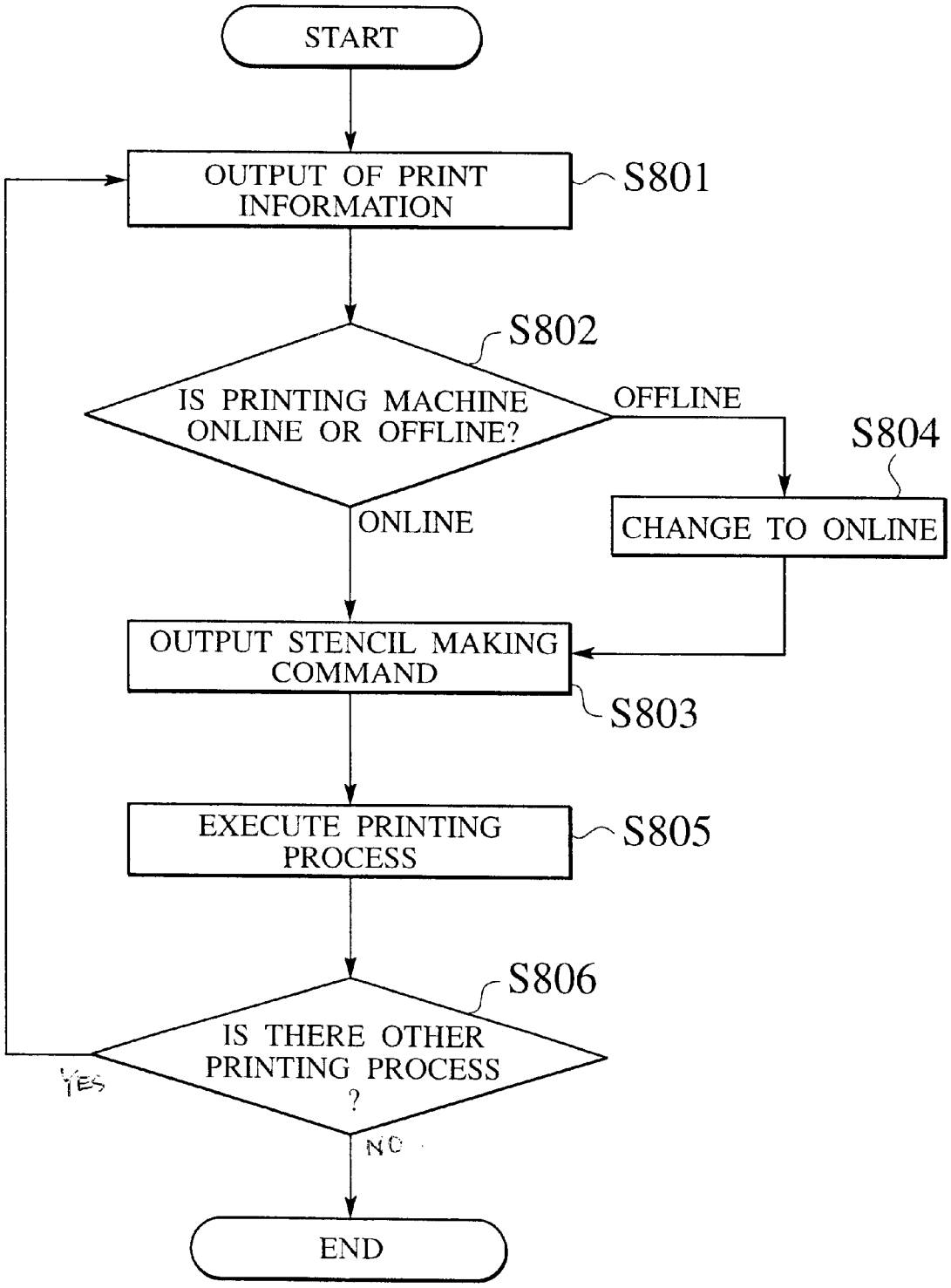
FIG. 2 PRIOR ART
FIG. 2 is a flowchart showing a conventional stencil printing method.

The stencil printing machine 10 of the embodiment of the invention is connected to the input and output unit 15 for input and output of various information about the printing process of the stencil printing machine 10, and the appearance of the input and output unit 15 is as shown in FIG. 2.

Figure 4:
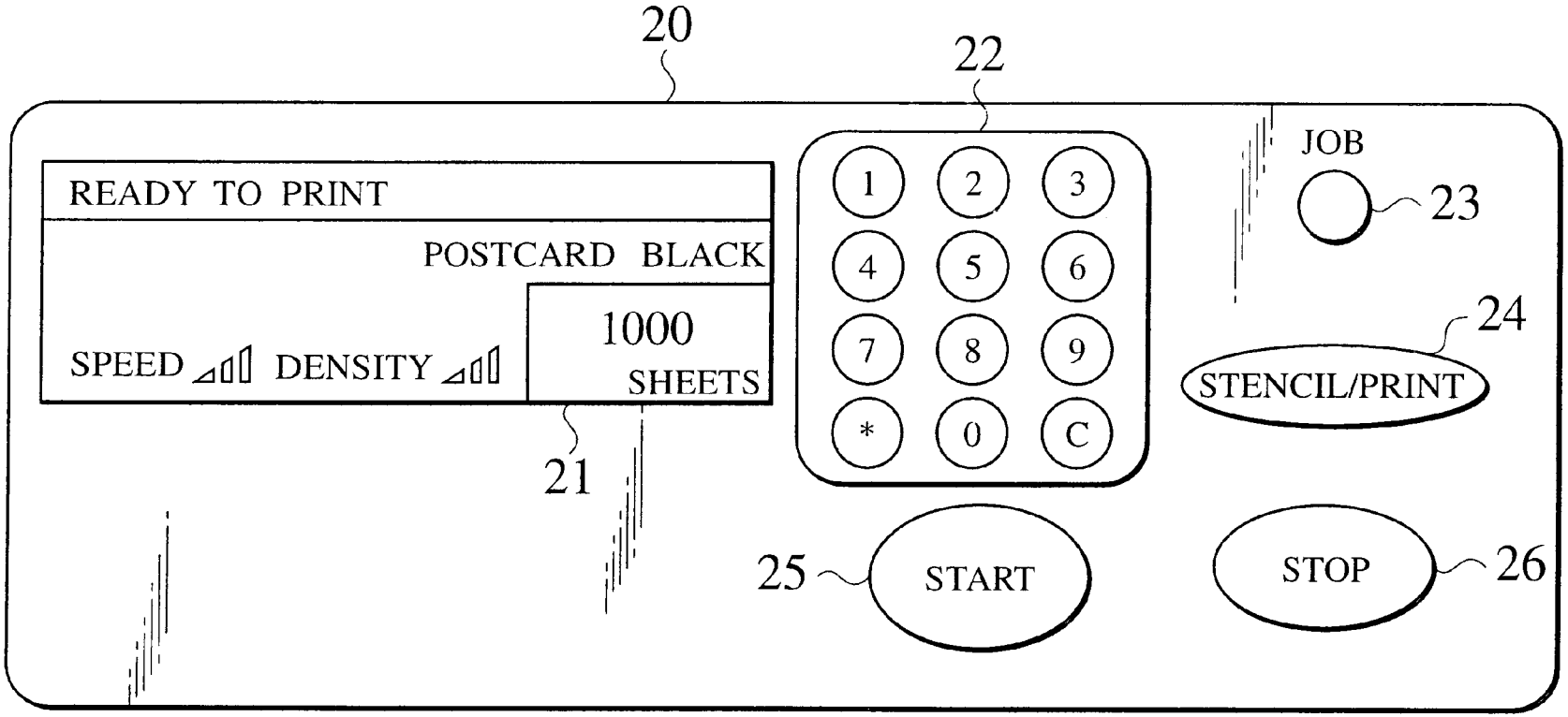
FIG. 4 is a block diagram showing an input and output unit of a stencil printing machine in the embodiment of the invention.
Figure 5:
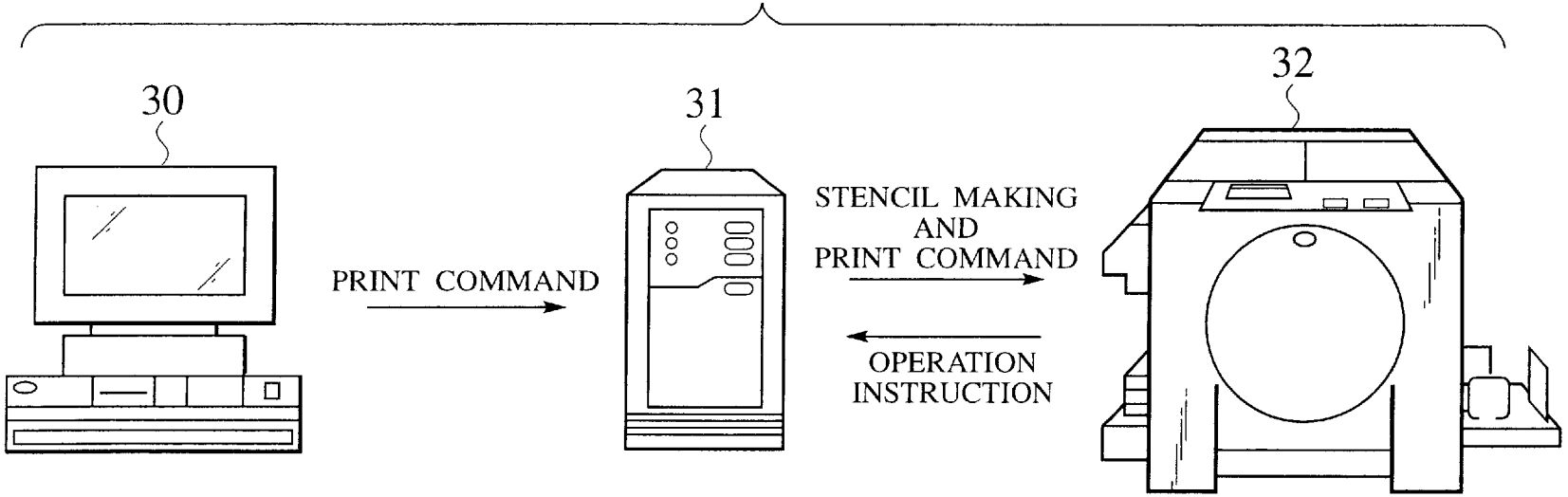
FIG. 5 is a schematic diagram showing a configuration of a stencil printing machine in the embodiment of the invention.

Referring to FIG. 4, the structure of the input and output unit 20 of the embodiment of the invention is briefly described. The state display unit 21 in the input and output unit 20 of the embodiment of the invention shows various information to the user, such as "Waiting for stencil making data", "Ready to make stencil", "Ready to remake stencil", "Ready to print", "Set number of copies of print", other processing information, printing speed, printing density, number of copies of print, monochromatic or color, and printing paper size. Figure keys 22 are used for input of number of copies of print, selection of function and others, and a job sensor 23, for example, flickers when receiving print information from the controller 17, lights when operating by the controller, and shows the status of processing to the user. A stencil/print button 24 changes over the stencil making mode and printing mode of the stencil printing machine, and start and stop buttons 25 and 26 command execution or stop of process to the stencil printing machine 10.

Referring successively to FIG. 6, the stencil printing method in the embodiment of the invention is explained.

In the stencil printing method of the embodiment of the invention, the stencil printing machine 10 detects the operation waiting state of the controller 17 and stencil printing machine 10, and executes the process shown in FIG. 6 depending on each state.

(a) When the Controller is in No-output State

Before the controller starts reception of output data from the computer system, the operation waiting state notice unit of the controller sends a signal showing no-output operation waiting state to the operation waiting state detector of the controller. The judging unit issues the following process execution command depending on the received signal and the operation state (stencil making mode or printing mode) of the stencil printing machine detected by the printing machine operation state detector.

(a-1) When the Stencil Printing Machine is in Stencil Making Mode

In the no-output operation waiting state of the controller, when the stencil making mode is selected at the stencil printing machine side and the start key is pressed, since the stencil printing machine is not equipped with scanner, the judging unit issues a stencil making operation ban signal to the input and output unit.

(a-2) When the Stencil Printing Machine is in Printing Mode

In the no-output operation waiting state of the controller, when the printing mode is selected at the stencil printing machine side and the start key is pressed, the stencil printing machine execute the printing process independently by using the stencil already set in the stencil printing machine.

(b) When the Controller is in Stencil Making Waiting State

When the controller receives output data from the computer system and the output preparation of the stencil making data is ready, the operation waiting state notice unit sends a signal showing stencil making waiting operation state to the controller operation waiting state detector. The judging unit issues the following process execution command depending on the received signal and the operation state of the stencil printing machine detected by the printing machine operation state detector.

(b-1) When the Stencil Printing Machine is in Stencil Making Mode

In the stencil making waiting operation state of the controller, when the stencil making mode is selected at the stencil printing machine side and the start key is pressed, since the controller is in the stencil making waiting operation state using the print information from the computer system, the judging unit issues a start command of stencil making process to the controller. The controller, corresponding to the command from the stencil printing machine, issues the print information of the computer system to the stencil printing machine, and the stencil printing machine start stencil making process by using the print information of the computer system. Herein, when the controller receives the print information from the computer system, the print information is developed, and corresponding to the developed print information, the information registering control parameters of the stencil printing machine such as the number of copies of print, printing speed and printing density determined in the computer system is transmitted to the stencil printing machine as the print information.

(b-2) When the Stencil Printing Machine is in Printing Mode

In the stencil making waiting operation state of the controller, when the stencil making mode is selected at the stencil printing machine side and the start key is pressed, the judging unit judges that the user is instructing independent printing process on the stencil printing machine by using the existing stencil, instead of execution of new stencil making process, and instructs execution of printing process by the stencil printing machine alone without issuing instruction of stencil making process start to the controller.

(c) When the Controller is in Printing Waiting State

When the controller finishes stencil making of output data from the computer system and is waiting for execution of next printing process, the operation waiting state notice unit sends a signal showing printing waiting operation state to the controller operation waiting state detector. The judging unit issues the following process execution command depending on the received signal and the operation state of the stencil printing machine detected by the printing machine operation state detector.

(c-1) When the Stencil Printing Machine is in Stencil Making Mode

In the printing waiting operation state of the controller, when the stencil making mode is selected at the stencil printing machine side and the start key is pressed, the judging unit judges that the user is demanding re-execution of stencil making process of printed sheet being printed at the present, and instructs start of execution of stencil re-making process to the controller. The stencil re-making process is, in the stencil printing machine, the process existing because the finish quality of the printed sheet is determined by the quality of the stencil, and usually it is executed when the stencil is damaged by repeated printing processes.

(c-2) When the Stencil Printing Machine is in Printing Mode

In the printing waiting operation state of the controller, when the printing mode is selected at the stencil printing machine side and the start key is pressed, the judging unit judges that the user is instructing execution of printing process to be executed by the controller, and hence issues a start instruction of printing process to the controller. The controller instructs start of operation of printing process to the stencil printing machine according to the instruction from the stencil printing process.

Figure 7:
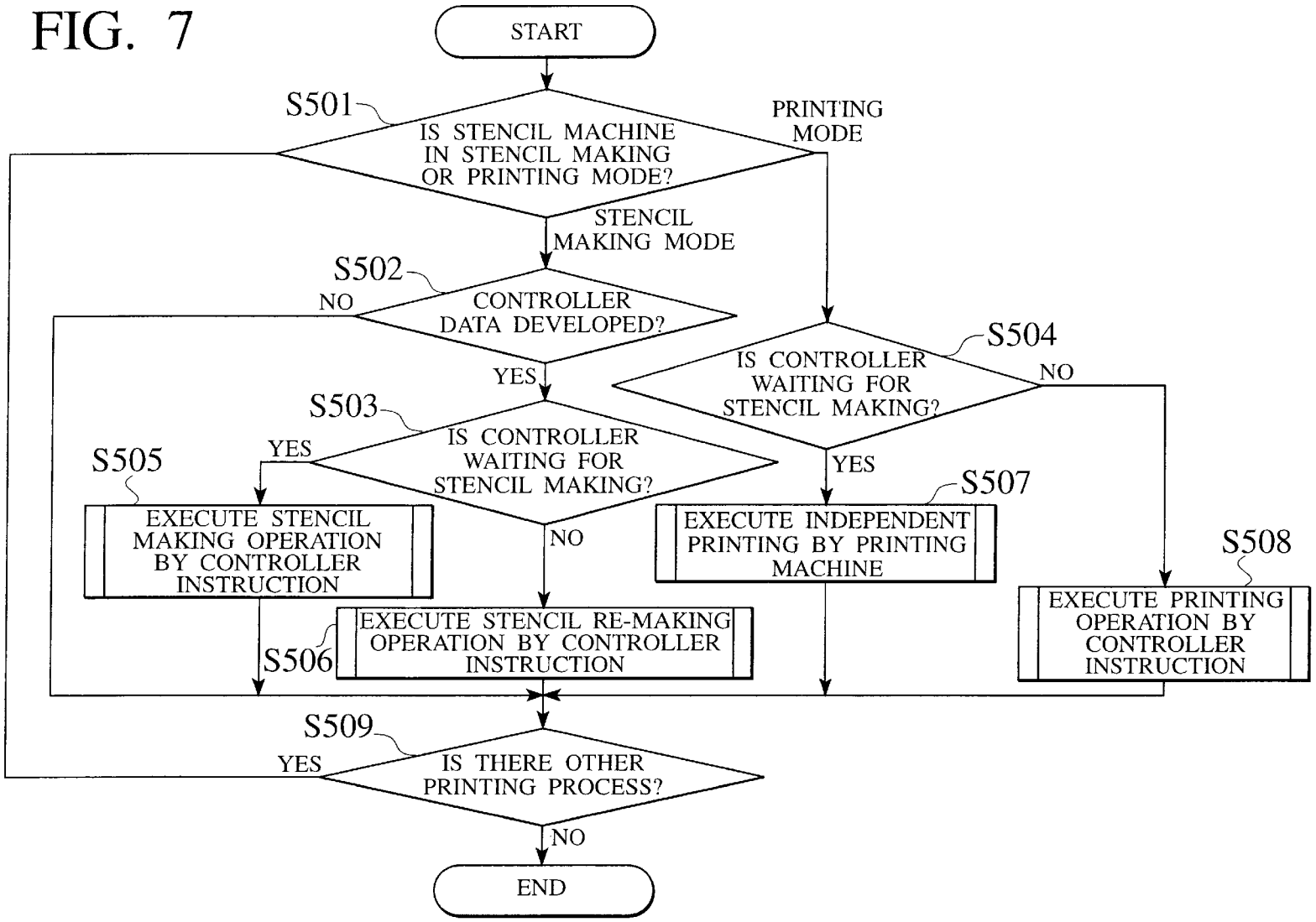
FIG. 7 is a flowchart showing the stencil printing method in the embodiment of the invention.

This series of steps is summarized in the flowchart in FIG. 7.

Referring then to the flowchart in FIG. 7, the stencil printing method according to the embodiment of the invention is explained below.

The stencil printing process conforming to the stencil printing method of the embodiment of the invention is executed in the following steps.

(1) The printing machine operation state detector 13*b* judges the operation state of the stencil printing machine 10 (printing machine mode judging step S501).

As a result of judgement, if the stencil printing machine 10 is in stencil making mode, the process goes to controller judging step II (S502), and when the stencil printing machine 10 is in printing mode, the process goes to the controller judging step IV (S504).

(2) When the stencil printing machine 10 is in stencil making mode, the controller operation state detector 13*a* judges if the controller 17 is in no-output operation state or not on the basis of the signal from the operation waiting state notice unit 17*a* (controller judging step II S502).

As a result of judgment, if the controller 17 is in no-output state, the process goes to printing process judging step (S509), and if the controller 17 is other than the no-output operation state, the process goes to the controller judging step III (503).

(3) When the stencil printing machine 10 is in stencil making mode and the controller 17 is other than no-output operation waiting state, the controller operation state detector 13*a* judges if the controller is in stencil making waiting operation state or not on the basis of the signal from the operation waiting state notice unit 17*a* (controller judging step III S503).

As a result of judgment, if the controller 17 is in stencil making waiting operation waiting state, the process goes to stencil making execution step (S505), or if the controller 17 is other than stencil making waiting operation state, the process goes to stencil re-making process step (S506).

(4) When the stencil printing machine 10 is in printing mode, the controller operation state detector 13*a* judges if the controller 17 is in stencil making waiting operation waiting state or not on the basis of the signal from the operation waiting state detector 17*a* (controller judging step IV S504).

As a result of judgement, if the controller 17 is in stencil making waiting operation waiting state, the process goes to independent printing process step (S507), or if the controller 17 is other than stencil making waiting operation waiting state, the process goes to printing process step (S508).

(5) The judging unit 13*c* issues an instruction to start stencil making process to the controller (stencil making process step S505) The controller, depending on the instruction from the stencil printing machine, issues development data of print information to the stencil printing machine, and the stencil printing machine starts stencil making process by using the print information of the computer system.

(6) The judging unit 13*c* instructs to start execution of stencil re-making process to the controller (stencil re-making step S506).

(7) The judging unit 13*c* executes printing process in the stencil printing machine independently by using the stencil already set in the stencil printing machine (independent printing process step S507).

(8) The judging unit 13*c* instructs to start printing process to the controller (printing process step S508). The controller instructs to start operation of printing process to the stencil printing machine depending on the instruction from the stencil printing machine.

(9) It is judged if there is any printing process not processed yet (printing process judging step S509). As a result, if there is other printing process, the process goes to the printing machine mode judging step (S501), and if there is no other printing process, a series of stencil printing process is terminated.

Meanwhile, if paper jamming or other error should occur in the midst of operation of printing process, the same process as mentioned above is executed. That is, the error is cleared, and when the printing process is continued with the same stencil, the user has only to press the start key whether it is the printing process by the instruction from the controller or the independent printing process of the stencil printing machine. More specifically, according to the stencil printing method in the embodiment of the invention, if occurring in the midst of printing process by the controller, the stencil printing machine instructs start of printing process to the controller, so that the printing process can be determined by the number of prints specified by the computer system. On the other hand, if occurring in the midst of printing process by the stencil printing machine alone, the stencil printing machine can continue the independent printing process.

The stencil printing method according to the embodiment of the invention may be compiled in a program, and stored in a computer-readable recording medium. When executing the printing process, this recording medium is read into the stencil printing machine, and the program is stored in the memory unit or the like, and by executing the stencil printing program by the CPU or other operating unit, the stencil printing method of embodiment of the invention is realized. Herein, the recording medium includes, for example, semiconductor memory, magnetic disk, optical disk, magneto-optical disk, magnetic tape and other computer-readable medium in which programs can be recorded.

Figure 8:
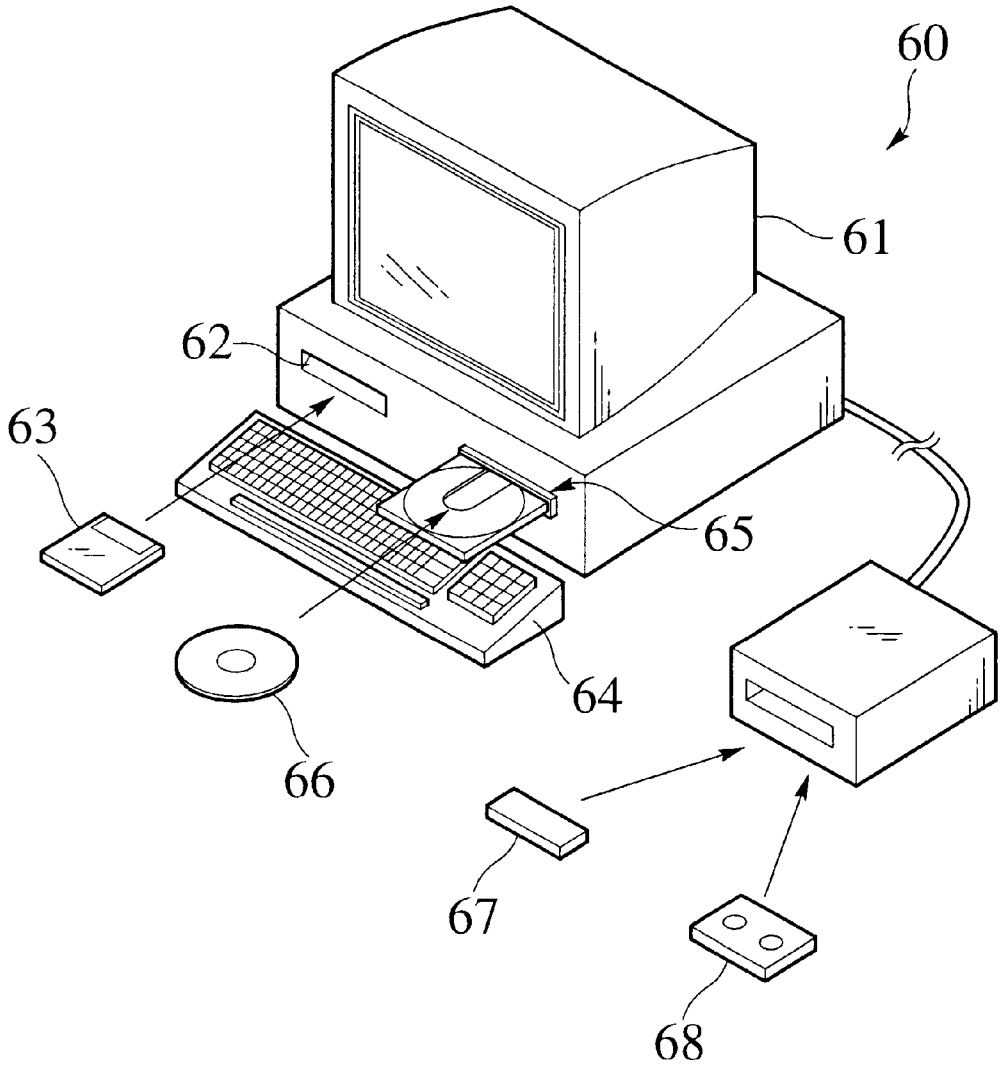
FIG. 8 is an appearance diagram of a computer system in the embodiment of the invention.

The computer system used in the stencil printing system of the embodiment of the invention has an appearance, for example, as shown in FIG. 8. That is, it comprises a floppy disk drive 62 and an optical disk drive 65, and a floppy disk 63 is inserted into the floppy disk drive 62, an optical disk 66 is inserted into the optical disk drive 65, and by the specified reading operation, the programs stored in these media can be installed in the system. Or, by connecting a specified drive device, for example, by using a ROM 67 playing the role of a memory device or a cartridge 68 playing the role of a magnetic tape device, installing or data reading can be executed. Further, the user can recognize the output information relating to the printing process by the output through a display 61, and also enter input information relating to the printing process through a keyboard 64. Although not shown herein, a mouse pointer may be used also as an input device.

OTHER EMBODIMENTS

Various modifications will become possible for those skilled in the art after receiving the teachings of the present disclosure without depending from the scope thereof.

Thus, the present invention includes various embodiments not illustrated herein. Therefore, the technical scope of the invention is determined only by the following claims reasonable from the above description.

What is claimed is:

1. A stencil printing method for receiving print information from a computer system through a controller, and executing stencil making and printing process of print information on a stencil printing machine, comprising the steps of:

detecting the operation waiting state of the controller;

detecting the operation state of the stencil printing machine;

determining the process to be executed on the stencil printing machine by referring to the operation waiting state of the controller and the operation state of the printing machine, and controlling the controller and the stencil printing machine.

2. The stencil printing method according to claim 1, wherein said operation waiting state of the controller includes the no-output state, stencil making process waiting state, and printing process waiting state, and said operation state of the printing machine includes the stencil making process state and the printing process state, and by referring to these states, the process to be executed on the stencil printing machine is determined.

3. A stencil printing system for receiving print information from a computer system through a controller, and executing stencil making and printing process of print information on a stencil printing machine, wherein said stencil printing machine comprising:

an operation waiting state detector for detecting the operation waiting state of the controller;

a printing machine operation state detector for detecting the operation state of the stencil printing machine; and a judging unit for determining the process to be executed on the stencil printing machine by referring to the operation waiting state of the controller and the operation state of the printing machine, and controlling the controller and the stencil printing machine.

4. The stencil printing system according to claim 1, wherein said operation waiting state of the controller includes the no-output state, stencil making process waiting state, and printing process waiting state, and said operation state of the printing machine includes the stencil making process state and the printing process state, and by referring to these states, the process to be executed on the stencil printing machine is determined.

5. A computer-readable recording medium storing a stencil printing program for receiving print information from a computer system through a controller, and executing stencil making and printing process of print information on a stencil printing machine, comprising and making a computer system execute the processes of:

detecting the operation waiting state of the controller;

detecting the operation state of the stencil printing machine;

determining the process to be executed on the stencil printing machine by referring to the operation waiting state of the controller and the operation state of the printing machine, and controlling the controller and the stencil printing machine.

6. The computer-readable recording medium storing a stencil printing program according to claim 5, wherein said operation waiting state of the controller includes the no-output state, stencil making process waiting state, and printing process waiting state, and said operation state of the printing machine includes the stencil making process state and the printing process state, and by referring to these states, the process to be executed on the stencil printing machine is determined.

* * * * *

UNITED STATES PATENT AND TRADEMARK OFFICE

CERTIFICATE OF CORRECTION

PATENT NO. : 6,401,607 B2
DATED : June 11, 2002
INVENTOR(S) : Hideharu Yoneoka

It is certified that error appears in the above-identified patent and that said Letters Patent is hereby corrected as shown below:

Column 10,
Line 32, change "1" to -- 3 --.

Signed and Sealed this

Second Day of September, 2003

JAMES E. ROGAN
*Director of the United States Patent and Trademark Office*